US008897671B2

(12) United States Patent
Tomatsu

(10) Patent No.: US 8,897,671 B2
(45) Date of Patent: Nov. 25, 2014

(54) IMAGE FORMATION APPARATUS

(75) Inventor: Yoshiya Tomatsu, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 189 days.

(21) Appl. No.: 13/362,672

(22) Filed: Jan. 31, 2012

(65) Prior Publication Data

US 2012/0251177 A1 Oct. 4, 2012

(30) Foreign Application Priority Data

Mar. 31, 2011 (JP) ..... 2011-078988

(51) Int. Cl.
*G03G 15/04* (2006.01)
*G03G 21/16* (2006.01)

(52) U.S. Cl.
CPC .... *G03G 21/1647* (2013.01); *G03G 2215/0141* (2013.01)
USPC ..... 399/119; 399/113; 399/112; 399/223; 399/299

(58) Field of Classification Search
USPC ..... 399/119, 113, 112, 223, 299
See application file for complete search history.

(56) References Cited

U.S. PATENT DOCUMENTS

| | | | | |
|---|---|---|---|---|
| 7,526,232 | B2 | 4/2009 | Kamimura et al. | |
| 8,103,193 | B2 | 1/2012 | Isobe et al. | |
| 2007/0053719 | A1 | 3/2007 | Kamimura et al. | |
| 2009/0190958 | A1 * | 7/2009 | Wang et al. | 399/228 |
| 2009/0257778 | A1 | 10/2009 | Isobe et al. | |

FOREIGN PATENT DOCUMENTS

| | | | |
|---|---|---|---|
| EP | 2 037 328 | A2 | 3/2009 |
| JP | 2003-263004 | A | 9/2003 |
| JP | 2004-013030 | A | 1/2004 |
| JP | 2007-072021 | A | 3/2007 |
| JP | 2008-058629 | A | 3/2008 |
| JP | 2009-069634 | A | 4/2009 |
| JP | 2009-251447 | A | 10/2009 |

OTHER PUBLICATIONS

Notification of Reasons for Rejection issued in Japanese Patent Application No. 2011-078988 mailed Mar. 26, 2013.
Notification of Reasons for Rejection issued in corresponding Japanese Patent Application No. 2011-078988 dated Jul. 16, 2013.

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

An image formation apparatus includes a driving source configured to supply a rotational driving force in a predetermined direction, a particular developing unit having a developing roller and accommodating particular color developer, a first gear configured to receive the driving force of the driving source, a second gear configured to transmit the driving force to the developing roller, a particular intermediate gear configured to be engaged with the first and the second gears. A rotational center of the particular intermediate gear is arranged on an upstream side in a moving direction of teeth of the second gear, and a translation member is configured to linearly move between a first position where the particular intermediate gear engages with the first and second gears, and a second position where the particular intermediate gear disengages from the particular intermediate gear.

17 Claims, 5 Drawing Sheets

IMAGE FORMATION APPARATUS

CROSS-REFERENCE TO RELATED APPLICATION

This application claims priority under 35 U.S.C. §119 from Japanese Patent Application No. 2011-078988 filed on Mar. 31, 2011. The entire subject matter of the application is incorporated herein by reference.

BACKGROUND

1. Technical Field

Aspects of the invention relate to an image formation apparatus such as a color laser printer.

2. Related Art

Typically, in the color laser printer, a plurality of photoconductive drums corresponding to colors of yellow, magenta and cyan are arranged. Further, in association with respective photoconductive drums, a plurality of developing units, which supply toner to respective photoconductive drums to form toner images, are provided.

When a color image is formed, each of the developing units is driven and a toner image is formed on each of the photoconductive drums. The toner images formed on respective photoconductive drums are transferred onto a printing sheet, directly or indirectly (e.g., via an intermediate transfer belt), a plurality of color toner images are overlaid and a color image is formed on the printing sheet.

When a monochrome image is formed, it is only necessary that a black toner image is formed on a photoconductive drum for forming a black image, which is transferred onto a printing sheet, directly or indirectly. Therefore, in such a case, it is only necessary to drive a developing unit for forming a black image, and it is not necessary to drive the developing units for forming yellow, magenta or cyan image.

SUMMARY

Conventionally, there has been suggested a color laser printer which is configured such that a first gear train for transmitting a driving force to the developing unit for a black image, and a second gear train for transmitting a driving force to each of the developing units for yellow magenta and cyan images are separately provided. Then, the driving force is selectively input to one of the first gear train or the second gear train.

According to an example of such a conventional configuration, an oscillating gear is arranged between the first and second gear trains, and a driving force of a motor is input to the oscillating gear. When the motor rotates in a first direction, the oscillating gear engages with, for example, the first gear train, and rotation of the oscillating gear is transmitted to the corresponding developing unit. When the motor rotates in a second direction which is opposite to the first direction, the oscillating gear engages with the second gear train, and the driving force of the motor is transmitted to the corresponding developing units via the second gear train. With such a configuration, when the monochrome image is formed, the developing units for the yellow, magenta and cyan images can be maintained to be stopped. Therefore, deterioration of toners in such developing units can be suppressed.

According to the conventional configuration described above, however, the motor is driven to rotate in opposite direction depending on whether the color image or monochrome image is formed. Therefore, it is difficult to use the driving form of the motor to drive other components of the printer. That is, the photoconductive drums, sheet feed rollers or the like is to be always rotated in a predetermined direction, and it is difficult to use the motor of which the rotation direction changes for driving such components.

In consideration of the above, aspects of the present invention provide an improved image formation apparatus in which a rotational driving force of a driving source is selectively transmitted to developing rollers, and further the rotational driving force can be used for driving other components in the image formation apparatus.

According to aspects of the invention, there is provided an image formation apparatus, which is provided with a driving source configured to supply a rotational driving force in a predetermined direction, a particular developing unit having a developing roller and accommodating particular color developer, a first gear configured to be supplied with the driving force of the driving source, a second gear configured to transmit the driving force to the developing roller, a particular intermediate gear configured to be engaged with the first gear and the second gear, a rotational center of the particular intermediate gear being arranged on an upstream side in a moving direction of teeth of the second gear on a line connecting a rotational center of the first gear and a rotational center of the second gear, a translation member configured to linearly move between a first position at which the particular intermediate gear engages with both the first gear and the second gear and a second position at which the particular intermediate gear disengages from the second gear.

According to aspects of the invention, there is provided an image formation apparatus which is provided with a driving source configured to supply a rotational driving force in a predetermined direction, a rotation member, a first gear configured to be supplied with the driving force of the driving source, a second gear configured to transmit the driving force to the rotation member, a particular intermediate gear configured to be engaged with the first gear and the second gear, a rotational center of the particular intermediate gear being arranged on an upstream side in a moving direction of teeth of the second gear on a line connecting a rotational center of the first gear and a rotational center of the second gear, and a translation member configured to linearly move between a first position at which the particular intermediate gear engages with both the first gear and the second gear and a second position at which the particular intermediate gear disengages from the second gear.

BRIEF DESCRIPTION OF THE ACCOMPANYING DRAWINGS

FIG. 1 schematically shows a cross-sectional side view of a color laser printer according to an exemplary embodiment of the invention.

DETAILED DESCRIPTION

Hereinafter, referring to the accompanying drawings, a color laser printer 1 will be described as an exemplary embodiment according to the present invention.

Figure 1:
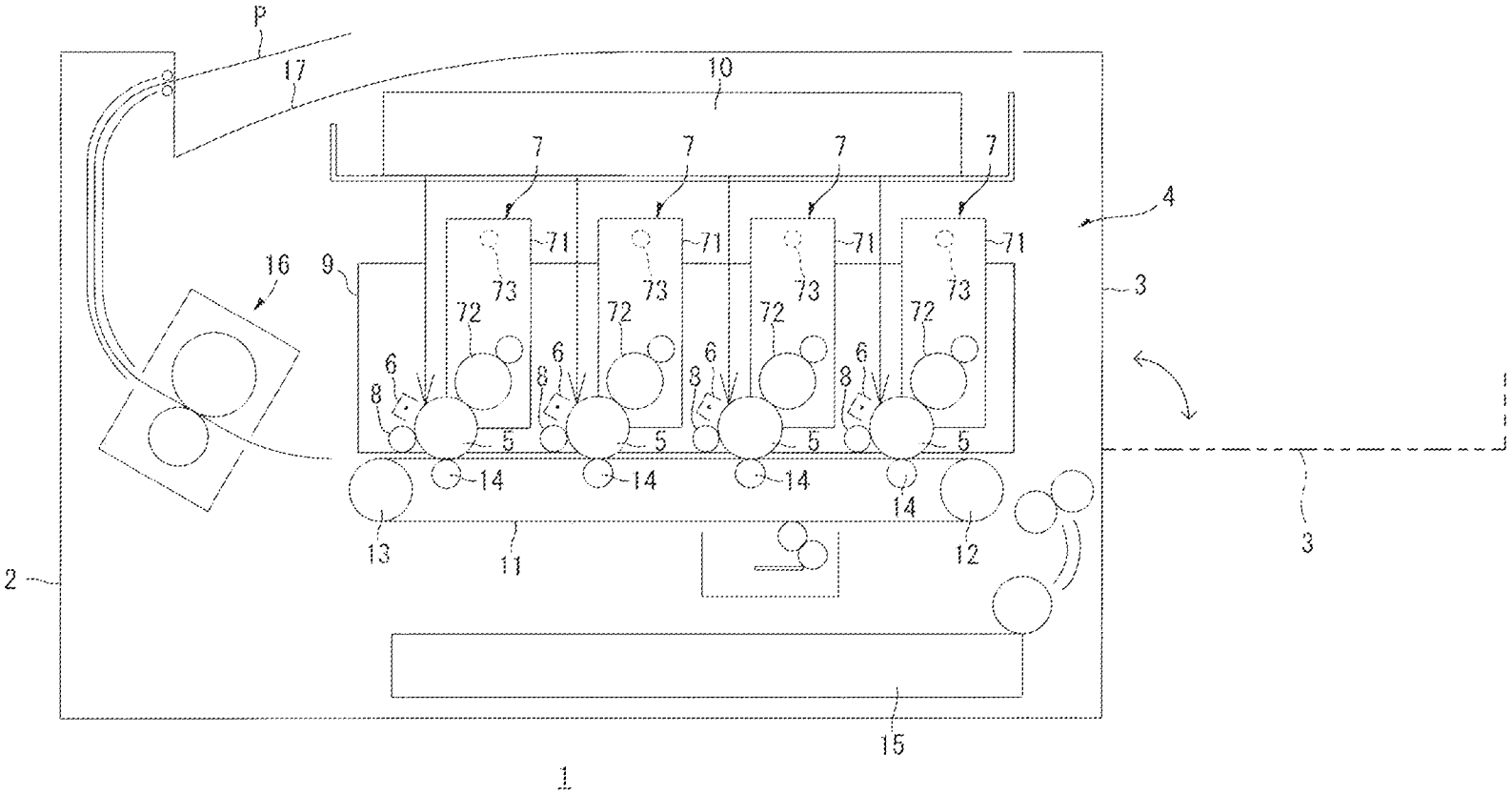

As shown in FIG. 1, the color laser printer 1 has a casing 2, and a front cover 3 is provided to openably covers an opening 4.

In the following description, directions are defined in view of a user of the color laser printer 1. In FIG. 1, a right-hand side is a front side of the color laser printer 1, and a left-hand side is a rear side thereof. A closer side and farther side with respect to a plane of FIG. 1 are left and right sides of the color laser printer 1, respectively. Up and down sides in FIG. 1 are up and down sides of the color laser printer 1, respectively.

The color laser printer 1 is configured to form a color image on a printing sheet in accordance with a well-known electrophotographic image formation method. According to the embodiment, four photoconductive drums 5 are arranged inside the casing 2. Each photoconductive drum 5 is arranged so that the circumferential surface thereof rotates about a rotary axis which extends in a right-and-left direction. The four photoconductive drums 5 are for forming black, yellow, magenta and cyan images, respectively, and are arranged from the rear side to the front side in this order at predetermined intervals.

A charging unit 6, a developing unit 7 and a toner collecting member 8 are arranged around each photoconductive drum (see FIG. 1). The developing unit 7 is arranged on upper front side of the photoconductive drum 5, and the collecting member 8 is arranged on a rear side of the photoconductive drum 5.

The developing unit 7 includes a container 71 accommodating toner, and a developing roller 72 which is supported by the container 71. At a lower end of the container, an elongated opening extending in the right-and-left direction is formed. The developing roller 72 is rotatably secured to the lower end portion of the container 71 such that the developing roller 72 can rotate about an axis extending in the right-and-left direction. A part of the circumferential surface of the developing roller 72 is exposed to outside through the elongated opening formed on the lower end portion of the container 71 and contacts the circumferential surface of the photoconductive drum 5. On upper ends of right and left side surfaces of the container 71, cylindrical pressing bosses 73 are provided to protrude toward right and left sides, respectively.

For simplifying description hereafter, the photoconductive drums 5 for forming yellow, magenta and cyan images will be collectively referred to as "color photoconductive drums" 5, while the photoconductive drum 5 for forming black images will be referred to a "black photoconductive drum" 5, when necessary. Similarly, the developing units 7 corresponding to the color photoconductive drums 5 will be referred to as "color developing units" 7, while the developing unit 7 corresponding to the black photoconductive drums 5 will be referred to as a "black developing unit" 7, when necessary.

At an upper portion inside the casing 2, an exposure unit 10 configured to emit four laser beams corresponding to the four color components.

When an image formation operation is executed, the photoconductive drums 5 are rotated counterclockwise when viewed from the left side (i.e., in FIG. 1). As each photoconductive drum 5 rotates, the circumferential surface is uniformly charged by the charging unit 6, and then selectively exposed to the laser beam emitted by the exposure unit 10. As a result, charges are selectively eliminated from the circumferential surface of the photoconductive drum 5, and an electrostatic latent image is formed thereon. Toner is supplied from a developing roller 72 of the developing unit 7, thereby the electrostatic latent image is developed (i.e., a toner image is formed).

Inside the casing 2, at a portion slightly lower than a center, in the up-and-down direction, a sheet feed bell 11 is provided. The sheet feed belt 11 is an endless belt wound around tow rollers 12 and 13. The two rollers 12 and 13 are horizontally the same position, and arranged in the front-and-rear direction with a certain interval therebetween. With this configuration, the sheet feed belt 11 has a planar portion extending in the front-and-rear direction between the upper ends of the rollers 12 and 13. The planar portion of the sheet feed belt 11 contacts the four photoconductive drums 5 (see FIG. 1).

The transfer rollers 14 are provided at positions opposite to the photoconductive drums 5 with the planar portion of the sheet feed belt 11 therebetween, respectively.

On the bottom portion of the casing 2, a sheet feed cassette 15, which accommodates the printing shects P, is arranged. The printing sheets P are sent to the planar portion of the sheet transfer belt 11 by rollers arranged in various locates one by one. Then, the printing sheet P is fed rearward, passing through the sheet feed belt 11 and each of the photoconductive drums 5 as the sheet transfer belt 11 rotates.

When an image is formed, the sheet feed belt 11 rotates counterclockwise viewed form right side (i.e., see FIG. 1). Transfer bias is applied to the transfer rollers 14. When a monochrome image is formed, a toner image is formed on the black photoconductive drum 5. Then, the toner image is transferred to the printing sheet P fed by the sheet feed belt 11 as the transfer bias is applied. As above, the monochrome image, or a black toner image is formed on the printing sheet P. If a color image is to be formed on the printing sheet P, toner images are formed on two or more photoconductive drums 5. Then, the toner images are transferred on the printing sheet P fed by the sheet feed belt 11 in an overlapped manner. As a result, a color image is formed on the printing sheet P.

After the images are transferred from the photoconductive drums 5 to the printing sheet P, residual toner and the like on each of the photoconductive drums 5 is removed by the collection member 8 with an effect of a collection bias applied to the collection member 8.

On a rear side of the sheet feed belt 11, a fixing device 16 is provided. The printing sheet P bearing the toner image is fed to the fixing device 16. By the fixing device 16, heat and pressure are applied and the toner image is fixed onto the printing sheet P. The printing sheet P on which the toner image is fixed is discharged, by feeding rollers, on a discharge tray 17 above the easing 2.

Figure 2:
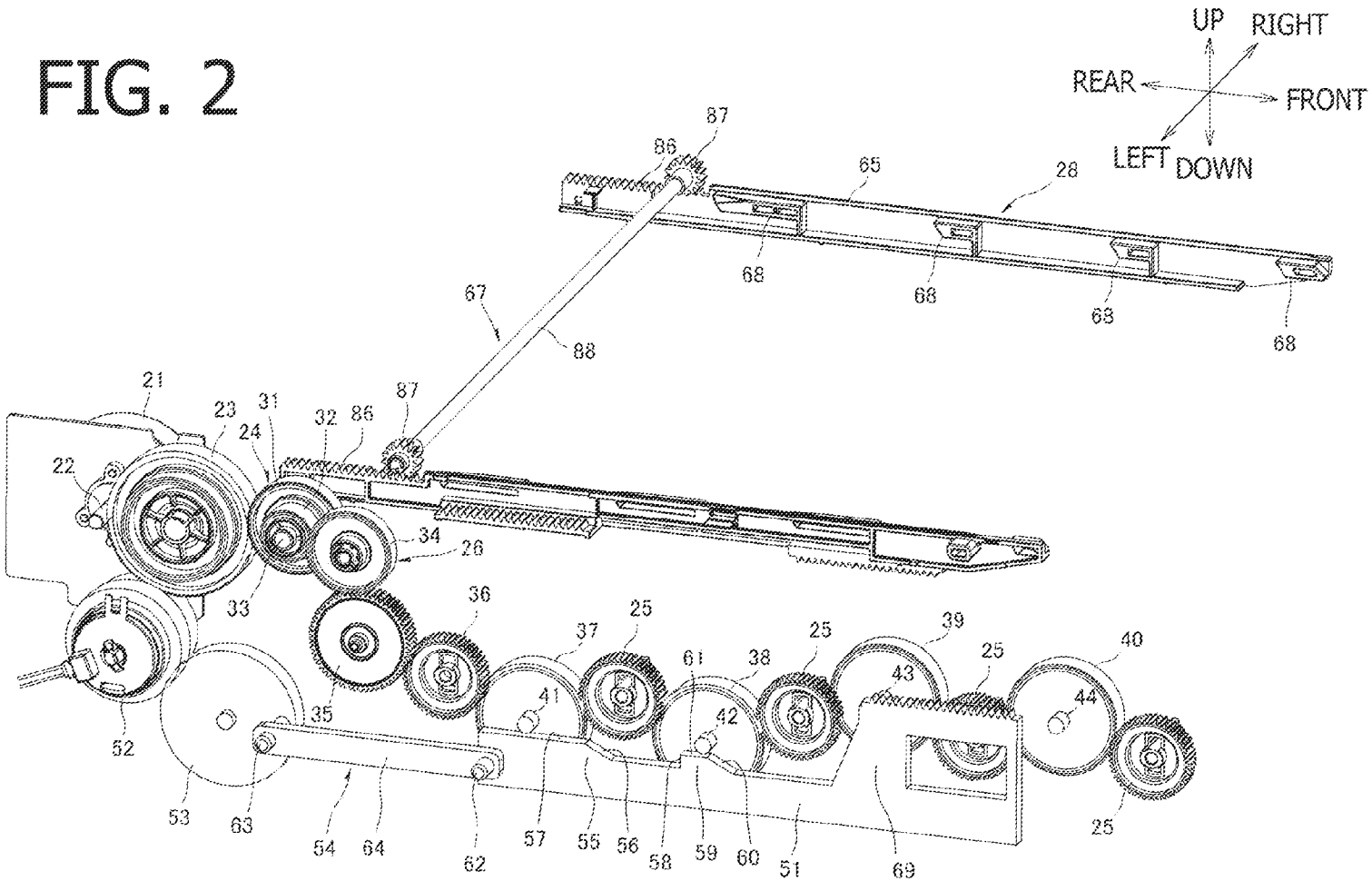
FIG. 2 is a perspective view of a driving mechanism employed in the color laser printer shown in FIG. 1.

Inside the casing 2, a motor 21 is proved (see FIG. 2). Further, in the casing 2, a motor gear 23 engaging a gear 22 secured to an output shaft of the motor 21, a two-stage gear 24 engaging with the motor gear 23, four developing gears 25, a driving force transmission mechanism 26 that transmits a rotational force of the two-stage gear 24 (i.e., the driving force from the motor 21) to the developing gears, a switching mechanism 27 that switches transmission/cutoff of rotations force of the driving force transmission mechanism 26, and an urging mechanism 28 that urges the developing unit 7 such that the developing roller 72 is urged toward the photoconductive drum 5.

The two-stage gear 24 includes an integrally formed large-diameter portion 31 and small-diameter portion 32. The large-diameter portion 31 and small-diameter portion 32 are rotatable with a rotary shaft 33, which is rotatably supported, for example, by the casing 2. The two-stage gear 24 is arranged on the front side of the motor gear 23.

The large-diameter portion 31 engages with the motor gear 23. Further, the large-diameter portion 31 engages with a gear train (not shown) that transmits the rotational force of the large-diameter portion 31 to the photoconductive drum 5.

The four developing gears 25 are rotatably arranged on the left surfaces of the containers 71 of the developing units 7, respectively. The four developing gears 25 are arranged at every predetermined interval in the front-and-rear direction. As rotational driving force is transmitted to the developing gears 25, various components that rotate by the rotational driving force such as the developing rollers 72 rotate.

The driving force transmission mechanism 26 includes a first transmission gear 34, a second transmission gear 35, a third transmission gear 36, a first intermediate gear 37, a second intermediate gear 38, a third intermediate gear 39 and a fourth intermediate gear 40. These gears are rotatably supported, for example, by the casing 2.

The first transmission gear 34 is arranged on the front side of the small-diameter portion 32 of the two-stage gear 24 and engaged therewith. The second transmission gear 35 is arranged below the first transmission gear 34 and engage therewith. The third transmission gear 36 is arranged on the lower front side of the second transmission gear 35, and at the same height level of the four developing gears 25. The third transmission gear 36 engages with the second transmission gear 35.

The rotary shaft 41 of the first intermediate gear 37 is arranged on a lower side with respect to a line connecting a rotational center of the third transmission gear 36 and the developing gear 25 of the black developing unit the rearmost developing unit) 25. The rotary shaft 41 is supported by the casing 2 so as to be slidable in the up-and-down direction. The first intermediate gear 37 engages with the third transmission gear 36 and the developing gear 25 of the black developing unit 7 from the below (see FIG. 2). In the following description, the developing gear 25 of the black developing unit 7 will be referred to as a black developing gear 25.

The rotary shaft 42 of the second intermediate gear 38 is arranged on the lower side with respect to a line connecting the rotational center of the black developing gear 25 and the developing gear 25 of the yellow developing unit 7 (i.e., the second developing unit 7 from the rear side). The rotary shaft 42 is supported by the casing 2 so as to be slidable in the up-and-down direction. The second intermediate gear 38 engages with the black developing gear 25 and the developing gear of the yellow developing unit 7 from the below (see FIG. 2). In the following description, the developing gear 25 of the yellow developing unit 7 will be referred to as a yellow developing gear 25.

The rotary shaft 43 of the third intermediate gear 39 is arranged on the upper side with respect to a line connecting the rotational center of the yellow developing gear 25 and the developing gear 25 of the magenta developing unit 7 (i.e., the third developing unit 7 from the rear side). The rotary shaft 43 is rotatably supported by the casing 2. The third intermediate gear 39 engages with the yellow developing gear 25 and the developing gear 25 of the magenta developing unit 7 from the above (see FIG. 2).

The rotary shaft 44 of the fourth intermediate gear 40 is arranged on the upper side with respect to a line connecting the rotational center of the developing gear 25 of the magenta developing unit 7 and the developing gear 25 of the cyan developing unit 7 (i.e., the front side developing unit 7). The rotary shaft 44 is rotatably supported by the casing 2. The fourth intermediate gear 40 engages with the developing gear 25 of the magenta developing unit 7 and the developing gear 25 of the cyan developing unit 7 from the above (see FIG. 2).

The switching mechanism 27 includes a cam member 51, a rotary member 53 to which the rotational driving force of the motor 21 is transmitted via the motor gear 23 and a electromagnet clutch 52, and a link mechanism 54 that converts the rotational movement of the rotary member 53 to a reciprocal linear movement of the cam member 51.

The cam member 51 is a translation cam having an thin plate member which is elongated in the front-and-rear direction and has a thickness in the right-and-left direction. The cam member 51 is arranged on the left side of the driving force transmission mechanism 26.

At the rear end portion of the cam member 51, a first cam portion 55 is formed to protrude upward. The first cam portion 55 has a trapezoidal shape in a side view. Specifically, as shown in FIG. 2, the first cam portion 55 has an upper face 57 extending in the front-and-rear direction, an inclined face 56 which inclines downward from the front side end of the upper face 57. The inclination angle of the inclined face 56 with respect to the upper face 57 is substantially the same as an inclination angle of a line connecting the rotary center of the third transmission gear 36 and the rotary center of the first intermediate gear 37 with respect to the upper face 57.

Further, the earn member 51 is formed with a second earn portion 59 on the front side of the first cam portion 55 and spaced therefrom. The second cam portion 59 protrudes upward. The second cam portion 59 has a trapezoidal shape in a side view. Specifically, the second cam portion 59 includes a rear face 58 extending upward from the upper face of the earn member 51, an upper face 61 extending forward from the upper end of the rear face 58, and an inclined face 60 which inclines downward from the front side end of the upper face 61. The inclination angle of the inclined face 60 with respect to the upper face of the cam member 51 is substantially the same as the inclination angle of a line connecting the rotary center of the black developing gear 25, the rotary center of the second intermediate gear 38 and the rotary center of the first intermediate gear 37.

The rotary member 53 is a disk-shaped member, which is rotatably supported by the casing 2 such that the axis of rotation extends in the right-and-left direction.

The link mechanism 54 includes a front link shaft 62 which protrudes to the left side from a rear end portion of the cam member 51, a rear link shaft 63 which protrudes to the left side from the rotary member 53, and a link member 64 which is an elongated thin plate member having a width in the right-and-left direction. On a front end portion of the link member 64, the front link shaft 62 is rotatably inserted, while the rear link shaft 63 is rotatably inserted on a rear end portion of the link member.

The urging mechanism 28 includes a pair of (i.e., right and left) linear movement members 65, a driving force transmission mechanism 66 that transmits a driving force to the left-side linear movement member 65 (see FIG. 3), and a synchronizing mechanism 67 that moves the right-side linear movement member 65 synchronously with the left-side linear movement member 65.

The pair of linear movement members 65 are arranged above the driving force transmission mechanism 26 and the switching mechanism 27, and spaced from each other in the right-and-left direction. Each of the linear movement members 65 is an elongated thin plate member extending in the front-and-rear direction, has a thickness in the right-and-left direction, and held by a holder (not shown) provided to the casing 2 so as to be movable in the front-and-rear direction.

On an inner surface, in the right-and-left direction, of each linear movement member 65, four active portions 68 are formed corresponding to urging bosses 73 of the four developing units 7. The four active portions 68 are arranged along the front-and-rear direction such that a distance between the front ends of the adjoining two active portions 68 is a predetermined value. It is noted that the active portion 68 corresponding to the urging boss 73 of the black developing unit 7 (i.e., the rearmost developing unit 7) is formed to be longer, in the front-and-rear direction, than the other three active portions 68. By differentiating the lengths as described above, it becomes possible to make all the developing rollers 72 contact the photoconductive drums 5, to make only the developing roller 72 of the black developing unit 7 (hereinafter, occasionally referred to as a black developing roller 72) contact the photoconductive drum 5. Further, it becomes possible to make all the developing rollers 72 press-contact the photoconductive drums 5, respectively, or release the press-contacted states.

Figure 3:
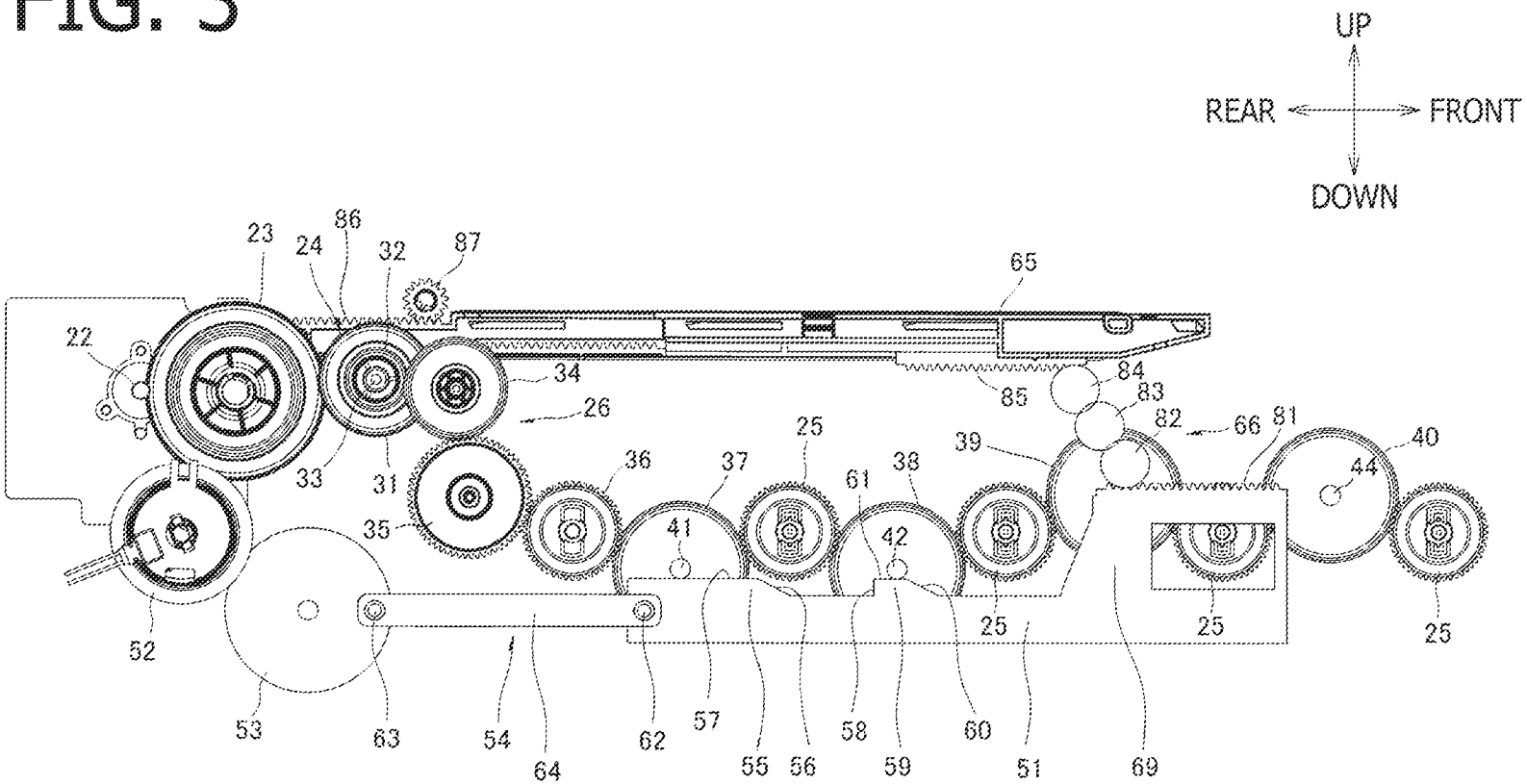
FIG. 3 is side view of the driving mechanism when the color laser printer operates in a color mode.

The driving force transmission mechanism 66 includes, as shown in FIG. 3, an output rack gear 81 formed at a front end portion of the cam member 51, a first transmission gear 82 to engage with the output rack gear 81, a second transmission gear 83 to engage with the first transmission gear 82, a third transmission gear 84 to engage with the second transmission gear, and an input rack gear 85 which is formed on the bottom face of the front end portion of the left-side linear movement member 65 and engage with the third transmission gear 84. The first, second and third transmission gears 82, 83 and 84 are rotatably supported by the casing 2. At the front end portion of the cam member 51, a protruded portion 69, which protrudes upward and has a trapezoidal shape, is formed. The output rack gear 81 is formed on the upper face of the protruded portion 69.

The synchronizing mechanism 67 includes, as shown in FIG. 2, a rack gear 86 formed on the upper face of the rear end portion of each linear movement member 65, a pinion gear 87 to engage with the rack gear 86, and a connecting shaft 88 to which the right and left pinion gears 87 are fixedly (i.e., not rotatably) secured.

The color printer 1 is configured to be operable in the color mode in which color images are printed on the printing sheets P, in the monochrome mode in which monochrome images are printed on the printing sheets P, and in a no-drive mode in which none of the developing rollers 72 is driven.

In the color mode, as shown n FIG. 3, the rear link shaft 63 is located on the front side of the rotation center of the rotary member 53, and the can member 51 and link member 64 are aligned in a line in the front-and-rear direction. In this state, the first cam portion 55 and the second cam portion 59 are located below the rotary shaft 41 of the first intermediate gear 37 and the rotary shaft 42 of the second intermediate gear 38, respectively. In other words, the rotary shaft 41 of the first intermediate gear 37 and the rotary shaft 42 of the second intermediate gear 38 contact the upper face 57 of the first cam portion 55 and the upper face 61 of the second cam portion 59, respectively. It is noted that a distance between the rotary shaft 41 of the first intermediate gear 37 and the rear end of the inclined face 56 of the first cam portion 55 is larger than the distance between the rotary shaft 42 of the second intermediate gear 38 and the rear end of the inclined face 60 of the second cam portion 59.

The first intermediate gear 37 engages with the third transmission gear 36 and the black developing gear 25. The second intermediate gear 38 engages with the black developing gear 25 and the yellow developing gear 25. The third intermediate gear 39 engages with the yellow developing gear 25 and the developing gear 25 of the developing unit 7 for the magenta image. The fourth intermediate gear 40 engages with the developing gear 25 of the developing unit 7 for the magenta image and the developing gear 25 of the developing unit for the cyan image.

When the motor 21 is driven, by the rotational force of the motor 21, the motor gear 23 rotates clockwise in left-side view (i.e., in FIG. 3). Then, the two-stage gear 23 engages with the motor gear 23 rotates counterclockwise in FIG. 3. The first transmission gear 34, which engages with the small-diameter portion 32 of the two-stage gear 24, rotate clockwise, and the second transmission gear 35 engaging with the first transmission gear 34 rotates counterclockwise (in FIG. 3). Further, the third transmission gear 36, which engages with second transmission gear 35, rotates clockwise in FIG. 3.

Since the first intermediate gear 37 engages with the third transmission gear 36 and the black developing gear 25, the first intermediate gear 37 rotates counterclockwise, and the black developing gear 25 rotates clockwise as the third transmission gear 36 rotates.

Since the second intermediate gear 38 engages with the black developing gear 25 and the yellow developing gear 25, the second intermediate gear 38 rotates counterclockwise, and the yellow developing gear 25 rotates clockwise as the black developing gear 25 rotates.

Since the third intermediate gear 39 engages with the yellow developing gear 25 and the developing gear 25 of the developing unit of magenta image, the third intermediate gear 39 rotates counterclockwise, and the developing gear 25 of the developing unit 7 for the magenta image rotates clockwise as the yellow developing gear 25 rotates.

Further, since the fourth intermediate gear 40 engages with the developing gear 25 of the developing unit for the magenta image and the developing gear 25 of the developing unit for the cyan image, the fourth intermediate gear 40 rotates counterclockwise, and the developing gear 25 of the developing unit 7 for the cyan image rotates clockwise as the yellow developing gear 25 rotates.

As described above, in the color mode, the rotational force of the motor 21 is transmitted to all the developing gears 25, all the developing gears 25 rotate. As a result, all the developing rollers 72 rotate.

In addition, in the color mode, the acting portions 68 of the linear movement members 65 are press-contacted with the pressing bosses 73 of each of the developing units 7. Therefore, all the developing rollers 72 are press-contacted with the photoconductive drums 5, respectively.

In the driving force transmission mechanism 66, the first transmission gear 82 engages with the end portion of the output rack gear 81, and the third transmission gear 84 engages with the front end portion of the input rack gear 85.

In the synchronizing mechanism 67, the pinion gear 87 engages with the front end portion of the rack gear 85.

Figure 4:
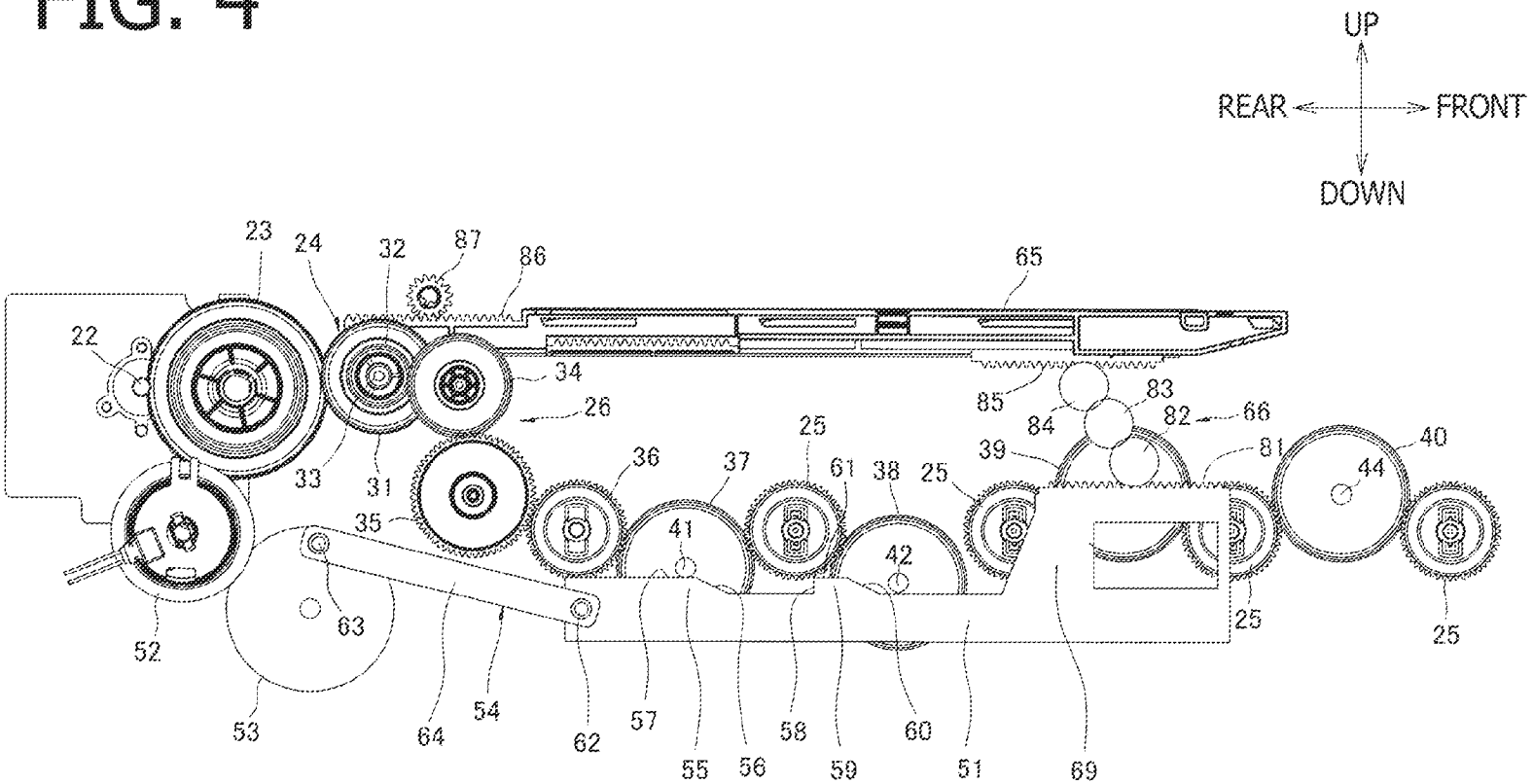
FIG. 4 is side view of the driving mechanism when the color laser printer operates in a monochrome mode.

When the operation mode is changed from the color mode to the monochrome mode, the electromagnetic clutch 52 is activated and the driving force of the motor 21 is transmitted to the rotary member 53, and the rotary member 53 rotates counterclockwise in left-side view by substantially 90 degrees. As the rotary member 53 rotates, as shown in FIG. 4, the rear link shaft 63 moves from the position on the front side with respect to the rotational center of the rotary member 53 to an upper position, and the rear end of the link member 64 moves to upper rear position with forming an our trajectory. In accordance with the movement of the link member 64, the cam member 51 moves rearward with maintaining its attitude to extend in the front-and-rear direction.

During the movement of the cam member 51 as above, the rotary shaft 42 of the second intermediate gear 38 is moves from the upper face 61 of the second cam portion 59 to the inclined face 60. With this movement of the cam member 51 thereafter, the rotary shaft 42 moves downward as guided by the inclined face 60. Thus, the second intermediate gear 38 moves downward with holding the engagement with the black developing gear 25, while moves away from the yellow developing gear 25. As a result, as shown in FIG. 4, the second intermediate gear 38 is disengaged from the yellow developing gear 25.

When the rotary member 53 stops rotating, the rotary shaft 42 is located on the upper face of the cam member 51, and the disengaged state between the second gear 38 and the yellow developing gear 25 is maintained thereafter.

Further, as the cam member 51 moves rearward, the first transmission gear 82 rotates clockwise in the left-side view (as shown in FIG. 4). As the first transmission gear 82 rotates, the second transmission gear 83 rotates counterclockwise, and the third transmission gear 84 rotates clockwise in the left-side view (as shown in FIG. 4). As the third transmission gear 84 rotates, the liner movement member 65 moves forward, and the acting portions 68 are separated from the pressure bosses 73. As a result, the urged status of the color developing units 7 with respect to the color photoconductive drums 5 is released. It is noted that the pressure posses 73 of the black developing unit 7 are still urged by the acting portions 68 from the above, and the black developing roller 72 is press-contacted with the black photoconductive drum 5.

In the monochrome mode, the motor 21 is driven with the second intermediate gear 38 being disengaged from the yellow developing gear 25. The rotational driving force from the motor 21 is transmitted to the black developing gear 25 via the motor gear 23, the two-stage gear 24, the first transmission gear 34, the second transmission gear 35, the third transmission gear 36 and the first intermediate gear 37, similar to the color mode. Further, since the black developing gear 25 is engaged with the second intermediate gear 38, the second intermediate gear 38 rotates counterclockwise in the left-side view (as shown in FIG. 4). However, since the second intermediate gear 38 is disengaged from the yellow developing gear 25, the rotation of the second intermediate gear 38 is not transmitted to the yellow developing gear 25.

Therefore, according to the above configuration, the black developing gear 25 rotates, while the other developing gears 25 do not rotate. As a result, only the black developing roller 72 rotates, and the other developing rollers 72 do not rotate.

Figure 5:
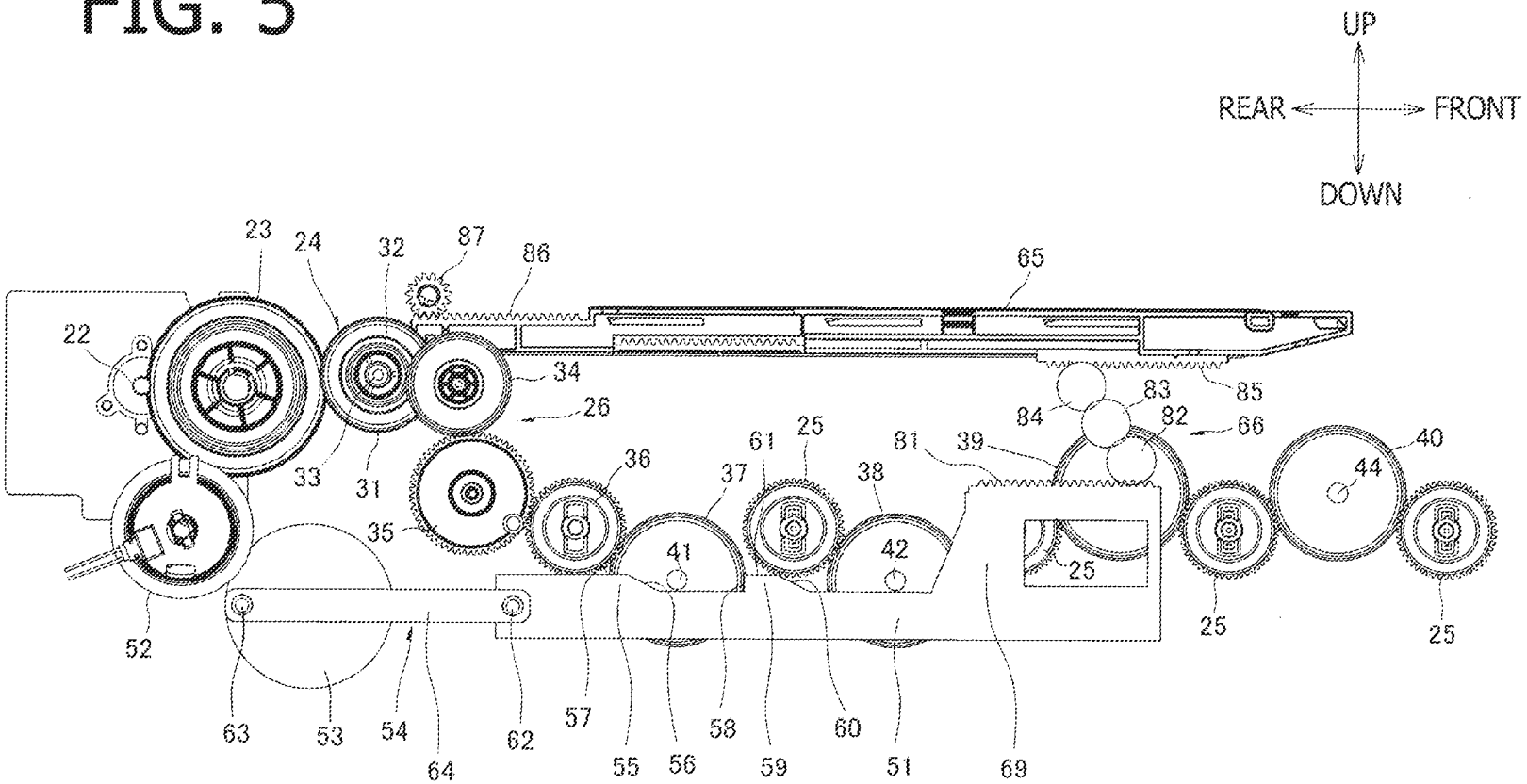
FIG. 5 is side view of the driving mechanism when the color laser printer is in a non-driven mode.

When the operation mode is changed from the monochrome mode to the no-drive mode, the electromagnetic clutch 52 is activated and the driving force of the motor 21 is transmitted to the rotary member 53, and the rotary member 53 rotates counterclockwise in left-side view by substantially 90 degrees. As the rotary member 53 rotates, as shown in FIG. 5, the rear link shaft 63 moves from the upper position above the rotational center of the rotary member 53 to a rear position, and the rear end of the link member 64 moves to lower rear position with forming an arc trajectory. In accordance with the movement of the link member 64, the earn member 51 moves rearward with maintaining its attitude to extend in the front-and-rear direction.

During the movement of the cam member 51 as above, the rotary shaft 41 of the first intermediate gear 37 is moves from the upper face 57 of the first cam portion 55 to the inclined face 56. With this movement of the cam member 51 thereafter, the rotary shaft 41 moves downward as guided by the inclined face 57. Thus, the first intermediate gear 37 moves downward with holding the engagement with the third transmission gear 36, while moves away from the black developing gear 25. As a result, as shown in FIG. 5, the first intermediate gear 37 is disengaged from the black developing gear 25.

When the rotary member 53 stops rotating, the rotary shaft 41 is located on the upper face 57 of the cam member 51, and the disengaged state between the first gear 37 and the black developing gear 25 is maintained thereafter.

Further, as the cam member 51 moves rearward, the first transmission gear 82 rotates clockwise in the left-side view (as shown in FIG. 5). As the first transmission gear 82 rotates, the second transmission gear 83 rotates counterclockwise, and the third transmission gear 84 rotates clockwise in the left-side view (as shown in FIG. 5). As the third transmission gear 84 rotates, the liner movement member 65 moves forward, and the acting portions 68 are separated from the pressure bosses 73 of the black developing unit 7. As a result, the urged status of the black developing units 7 with respect to the black photoconductive drums 5 is released. Thus, the urged status of all the developing units 7 with respect to all the photoconductive drums 5 is released.

In the no-drive mode, since the first intermediate gear 37 is disengaged from the black developing gear 25, even if the motor 21 is driven, no force is transmitted from the motor 21 to the black developing gear 25. Therefore, according to the no-drive mode, drivable components other than the developing rollers 72 can be driven with the rotational force of the motor 21 with stopping all the developing rollers 72.

When the operation mode is changed from the no-drive mode to the color mode, the electromagnetic clutch 52 is activated and the driving force of the motor 21 is transmitted to the rotary member 53, and the rotary member 53 rotates counterclockwise in left-side view by substantially 180 degrees. As the rotary member 53 rotates, the rear link shaft 63 moves from the rear position to the front position of the rotational center of the rotary member 53, and the rear end of the link member 64 moves with forming an arc trajectory. In accordance with the movement of the link member 64, the cam member 51 moves forward with maintaining its attitude to extend in the front-and-rear direction.

During the movement of the cam member 51 as above, the inclined face 57 of the first cam portion 55 contacts the rotary shaft 41 of the first intermediate gear 37. Thereafter, as the cam member 51 further moves forward, the rotary shaft 41 receives a force to lift the rotary shaft 41 upward by the inclined face 57. With this configuration, the first intermediate gear 37 moves upward and engages with the black developing gear 25 with maintaining the engaged status with respect to the third transmission gear 36.

Further, during the movement of the cam member 51 in the front direction, the inclined face 60 of the second cam portion 59 contacts the rotary shaft 42 of the second intermediate gear 38. Thereafter, as the cam member 51 further moves forward, the rotary shaft 42 receives a force to lift the rotary shaft 42 upward by the inclined face 60. With this configuration, the second intermediate gear 38 moves upward and engages with the yellow developing gear 25 with maintaining the engaged status with respect to the black developing gear 25.

As described above, the color laser printer 1 is provided with the third transmission gear 36, the black developing gear 25, and the first intermediate gear 37. The rotational force from the motor 21 in a predetermined direction is transmitted to the third transmission gear 36. The first intermediate gear 37 is configured such that engagement/disengagement status with respect to the black developing gear 25 is selected.

Further, the cam member 51 is configured to be movable linearly in the front-and-rear direction. By moving the can member linearly, an operation mode can be switched between a first mode and a second mode.

In the first mode, the third transmission gear 36 and the black developing gear 25 are engaged with the first intermediate gear 37. Thus, the rotational driving force transmitted to the third transmission gear 36 can be transmitted to the black developing gear 25 via the first intermediate gear 37, and then, transmitted to the black developing roller 72 via the black developing gear 25.

In the second mode, the engagement of the black developing gear 25 with respect to the first intermediate gear 37 is released. Therefore, in the second mode, the rotational force transmitted to the third transmission gear is not transmitted to the black developing gear 25 or the black developing roller 72. Thus, in the second mode, the black developing roller 72 does not rotate.

As above, the rotational force of the motor 21 can be selectively transmitted/blocked. Therefore, when it is unnecessary to rotate the black developing roller 72, rotation of the black developing roller 72 can be prevented. As a result, deterioration of toner due to unnecessary rotation of the black developing roller 72 and attrition of the black developing roller 72 can be prevented.

In the second mode, the rotational force of the motor 21 can be utilized to drive movable components other than the developing rollers 25. That is, the motor 21 can be used as a drive source for the movable components other than the developing rollers 25.

The rotary center of the first intermediate gear 37 is managed, with respect to a line segment connecting the rotational center of the third transmission gear 36 and the rotational center of the black developing gear 25, on an upstream side in the moving direction of the teeth of the black developing gear 25 on the line segment. In other words, the rotational center of the first intermediate gear 37 is arranged, with respect to a line segment connecting the rotational center of the third transmission gear 36 and the rotational center of the black developing gear 25, on a downstream side in the moving direction of the teeth of the third transmission gear 36 on the line segment.

With this configuration, when the rotational force is transmitted from the third transmission gear 36 to the first intermediate gear 37, the first intermediate gear 37 receives, from the third transmission gear 36, a force opposite to a force when the first intermediate gear 37 engages with the black developing gear 25. Further, when the rotational force is transmitted from the first intermediate gear 37 to the black developing gear 25, the first intermediate gear 37 receives, from the black developing gear 25, a force opposite to a force when the first intermediate gear 37 engages with the third transmission gear 36 as a reactive force.

Therefore, when the engagement of the black developing gear 25 with the first intermediate gear 37 is released, the first intermediate gear 37 can easily be disengaged from the black developing gear 25. Therefore, according to the embodiment, the engagement between the black developing gear 25 and the first intermediate gear 37 can be released smoothly.

The cam member 51 is formed with the first intermediate cam portion 55. As the cam member 51 linearly moves and the first cam portion 55 cause the first intermediate gear 37 to move, the third transmission gear 36 and the black developing gear 25 engage with the first intermediate gear 37.

Specifically, the first cam portion 55 has the inclined face 56. As the cam member 51 moves, the inclined face 56 contacts the rotary shaft 41 of the first intermediate gear 37. As the first intermediate gear 37 receives a lifting force from the inclined face 56, the first intermediate gear 37 moves upward, and the third transmission gear 36 and the black developing gear 25 are engaged with the first intermediate gear 37.

The inclination angle of the inclined surface 56 with respect to a line parallel with the moving direction of the cam member 51 is substantially the same as the inclination angle of a line connecting the rotational centers of the third transmission gear 36 and the first intermediate gear 37 with respect to the line parallel with the moving direction of the cam member 51. Therefore, it is possible that the inclined surface 56 applies a force to the rotary shaft 41 of the first intermediate gear 37 in a direction perpendicular to a line connecting the rotary center of the first intermediate gear 37 and the rotary center of the black developing gear 25. As a result, it becomes possible to move the first intermediate gear 37 to move about the rotary center of the third transmission gear 36 smoothly, and to engage the first intermediate gear 37 with the third transmission gear 36 and the black developing gear 25 in good condition.

The color laser printer 1 has the developing unit 7 for forming yellow images. Such a developing unit 7 has the developing roller 72 (i.e., yellow developing a roller) for applying yellow toner to the photoconductive drum 5. The color laser beam printer 1 further includes the yellow developing gear 25 which transmits the rotational force to the yellow developing roller 72.

According to the embodiment, by the linear movement of the cam member 51, the operation mode can be switched among the first, second and third modes. Further, the second intermediate gear 38 can be engaged with/disengaged from the yellow developing gear 25.

In the first mode, the first intermediate gear 37 engages with both the third transmission gear 36 and the black developing gear 25, and the second intermediate gear 38 engages with both the black developing gear and the yellow developing gear 25. Therefore, the rotational force transmitted to the third transmission gear 36 is transmitted to the black developing gear 25 via the first intermediate gear 37, then transmitted to the yellow developing gear 25 via the second intermediate gear 38. As a result, the black developing roller 72 and the developing rollers 72 of the color developing units 7 rotate.

In the second mode, the engagement of the black developing gear with the first intermediate gear is released. Further, the engagement of the yellow developing gear 25 with the second intermediate gear 38 is released. Therefore, in the second mode, the rotational force transmitted to the third transmission gear 36 is not transmitted to black developing gear 25 or the yellow developing gear 25. Therefore, none of the black developing roller 72 and the developing rollers 72 of the color developing units 7 rotates.

In the third mode, the first intermediate gear 37 engages with both the third transmission gear 36 and the black developing gear 25, while the second intermediate gear 38 is disengaged from the yellow developing gear 25. Thus, the rotational force transmitted to the third transmission gear 36 is transmitted to the black developing gear 25 via the first intermediate gear 37, while is not transmitted to the yellow developing gear 25. Therefore, the black developing roller 72 rotates, but none of the developing rollers 72 of the color developing units 7 rotates.

As above, the rotational driving force of the motor 21 can be selectively transmitted to both of the black developing roller 72 and other developing rollers 72 of the color developing units 7, or only to the black developing roller 72. Therefore, if it is unnecessary to rotate the developing rollers 72 of the color developing units 7, they can be stopped, while rotating the black developing roller 72. As a result, deterioration of toner and attrition of the developing rollers 72 due to unnecessary rotation of the developing rollers 72 can be prevented.

The rotary center of the second intermediate gear 38 is arranged, with respect to a line segment connecting the rotational center of the rotational center of the black developing gear 25 and the rotational center of the yellow developing gear 25, on an upstream side in the moving direction of the teeth of the yellow developing gear 25 on the line segment. In other words, the rotational center of the second intermediate gear 38 is arranged, with respect to a line segment connecting the rotational center of the black developing gear 25 and the rotational center of the yellow developing gear 25, on a downstream side in the moving direction of the teeth of the black developing gear 25 on the line segment.

With this configuration, when the rotational force is transmitted from the black developing gear 25 to the second intermediate gear 38, the second intermediate gear 38 receives, from the black developing gear 25, a force opposite to a force when the second intermediate gear 38 engages with the yellow developing gear 25. Further, when the rotational force is transmitted from the second intermediate gear 38 to the yellow developing gear 25, the second intermediate gear 38 receives, from the yellow developing gear 25, a force opposite to a force when the second intermediate gear 38 engages with the black developing gear 25 as a reactive force.

Therefore, when the engagement of the yellow developing gear 25 with the second intermediate gear 38 is released, the second intermediate gear 38 can easily be disengaged from the yellow developing gear 25. Therefore, according to the embodiment, the engagement between the yellow developing gear 25 and the second intermediate gear 38 can be released smoothly.

The cam member 51 is formed with the second cam portion 59. As the cam member 51 linearly moves, the second cam portion 59 moves the second intermediate cam 38, thereby the second intermediate gear 38 engaging with the black developing gear 25 and the yellow developing gear 25.

Specifically, the second cam portion 59 has the inclined face 60. As the cam member 51 moves, the inclined face 60 contacts the rotary shaft 42 of the second intermediate gear 38. As the second intermediate gear 38 receives a lifting force from the inclined face 60, the second intermediate gear 38 moves upward, and the black developing gear 25 and the yellow developing gear 25 are engaged with the second intermediate gear 38.

The inclination angle of the inclined surface 60 with respect to a line parallel with the moving direction of the cam member 51 is substantially the same as the inclination angle of a line connecting the rotational centers of the black developing gear 25 and the second intermediate gear 37 with respect to the line parallel with the moving direction of the cam member 51. Therefore, it is possible that the inclined surface 60 applies a force to the rotary shaft 43 of the second intermediate gear 38 in a direction perpendicular to a line connecting the rotary center of the second intermediate gear 38 and the rotary center of the yellow developing gear 25. As a result, it becomes possible to move the second intermediate gear 38 to move about the rotary center of the black developing gear 25 smoothly, and to engage the second intermediate gear 38 with the black developing gear 25 and the yellow developing gear 25 in good condition.

The color laser printer 1 is provided with a black photoconductive drum to which black toner is supplied from the black developing unit 7, and color photoconductive drums to which color toners are supplied from the color developing units 7, respectively. Further, the color laser printer 1 is provided with urging mechanism 28 which press-contact the developing rollers to the black photoconductive drum and color photoconductive drums.

The urging mechanism 28 makes use of the rotational driving force from the motor 21 to press-contact the developing rollers to the photoconductive drums and/or release the same. That is, the motor 21 is used as a driving source of the urging mechanism 28. With this configuration, the number of driving sources can be reduced.

The switching mechanism 27 includes the rotary member 53 that rotates by the rotational driving force of the motor 21, and the link mechanism 54 which converts the rotational movement of the rotary member 53 to a reciprocal movement of a cam member 51. Thus, a linear movement of the cam member 51 can be realized using the motor 21 as the drive source. Thus, since the motor 21 can be used as a driving source of the cam member 51, the number of the driving sources can be reduced.

It is noted that the invention needs not be limited to the configuration described with reference to the exemplary embodiment, and can be modified in various ways without departing from the scope of the invention.

For example, the first intermediate gear 37 is configured to engage with/disengage from the black developing gear 25 according to the exemplary embodiment. This configuration may be modified such that the first intermediate gear 37 is configured to engage with/disengage from the third transmission gear 36.

For another example, the second intermediate gear 38 is configured to engage with/disengage from the yellow developing gear 25. This configuration may be modified such that the second intermediate gear 38 is configured to engage with/disengage from the black developing gear 25, or both the black and yellow developing gears 25.

What is claimed is:

1. An image formation apparatus, comprising:

a driving source configured to supply a rotational driving force in a predetermined direction;

a particular developing unit having a developing roller and accommodating particular color developer;

a first gear configured to receive the driving force of the driving source;

a second gear configured to transmit the driving force to the developing roller to provide rotation of the developing roller;

a particular intermediate gear configured to be engaged with the first gear and the second gear, a rotational center of the particular intermediate gear being arranged on an upstream side in a moving direction of teeth of the second gear on a line connecting a rotational center of the first gear and a rotational center of the second gear; and a translation member configured to linearly move between a first position at which the particular intermediate gear engages with both the first gear and the second gear and a second position at which the particular intermediate gear disengages from the second gear.

2. The image formation apparatus according to claim 1, wherein the translation member having a particular cam portion configured to move the particular intermediate gear to engage with the first gear and the second gear.

3. The image formation apparatus according to claim 2, wherein:

the particular cam portion has an inclined face configured to move the particular intermediate gear in association with movement of the translation member; and an inclination angle of the inclined face with respect to a reference line parallel with a moving direction of the translation member is substantially the same as an inclination angle of a line connecting a rotational center of the first gear and the rotational center of the particular intermediate gear with respect to the reference line.

4. The image formation apparatus according to claim 1, further comprising:

a further developing unit having a developing roller and accommodating further color developer that is different from the particular color developer;

a third gear configured to transmit the rotational driving force to the further developing unit of the developing roller; and a further intermediate gear configured to be engaged with the second gear and the third gear, a rotational center of the further intermediate gear being arranged on an upstream side in a moving direction of teeth of the third gear on a line connecting a rotational center of the second gear and a rotational center of the third gear, wherein the translation member is configured to linearly move among:

a first position at which the particular intermediate gear engages with both the first gear and the second gear, and the further intermediate gear engages with both the second gear and the third gear;

a second position at which at least the engagement between the particular intermediate gear and the second gear is released; and a third position at which the particular intermediate gear engages with both the first gear and the second gear, while the further intermediate gear is disengaged from the third gear.

5. The image formation apparatus according to claim 4, wherein the translation member has a further cam portion configured to move the further intermediate gear to engage with the second gear and the third gear.

6. The image formation apparatus according to claim 5, wherein:

the further cam portion has an inclined face configured to move the further intermediate gear in association with movement of the translation member; and an inclination angle of the inclined face with respect to a reference line parallel with a moving direction of the translation member is substantially the same as an inclination angle of a line connecting a rotational center of the third gear and the rotational center of the further intermediate gear with respect to the reference line.

7. The image formation apparatus according to claim 4, further comprising:

a first photoconductive drum configured to be supplied with the particular color developer;

a second photoconductive drum configured to be supplied with a further color developer; and an urging mechanism configured to:

press-contact the first developing roller and the second developing roller to the first photoconductive drum and the second photoconductive drum, respectively, at the first position;

disengage the first developing roller and the second developing roller from the first photoconductive drum and the second photoconductive drum, respectively, at the second position; and press-contact the first developing roller to the first photoconductive drum and disengage the second developing roller from the second photoconductive drum at the third position.

8. The image formation apparatus according to claim 1, further comprising:

a rotary member configured to be rotated by the rotational driving force; and a link mechanism configured to convert the rotational movement of the rotary member to a reciprocal linear movement, the reciprocal linear movement being used as a driving force of the translation member.

9. The image formation apparatus according to claim 1, further comprising:

a first photoconductive drum configured to be supplied with the particular color developer;

a second photoconductive drum configured to be supplied with the further color developer; and a drum driving force transmission mechanism configured to transmit the rotational driving force to the first photoconductive drum and the second photoconductive drum.

10. The image formation apparatus according to claim 1, wherein the particular color is black.

11. The image formation apparatus according to claim 4, wherein the further color is a color other than black.

12. An image formation apparatus comprising:

a driving source configured to supply a rotational driving force in a predetermined direction;

a rotation member;

a first gear configured to be supplied with the driving force of the driving source;

a second gear configured to transmit the driving force to the rotation member to provide rotation of the rotation member;

a particular intermediate gear configured to be engaged with the first gear and the second gear, a rotational center of the particular intermediate gear being arranged on an upstream side in a moving direction of teeth of the second gear on a line connecting a rotational center of the first gear and a rotational center of the second gear; and a translation member configured to linearly move between a first position at which the particular intermediate gear engages with both the first gear and the second gear and a second position at which the particular intermediate gear disengages from the second gear.

13. The image formation apparatus according to claim 12, wherein the translation member having a particular cam portion configured to move the particular intermediate gear to engage with the first gear and the second gear.

14. The image formation apparatus according to claim 13, wherein:

the particular cam portion has an inclined face configured to move the particular intermediate gear in association with movement of the translation member; and an inclination angle of the inclined face with respect to a reference line parallel with a moving direction of the translation member is substantially the same as an inclination angle of a line connecting a rotational center of the first gear and the rotational center of the particular intermediate gear with respect to the reference line.

15. The image formation apparatus according to claim 12, further comprising a rotary member configured to be rotated by the rotational driving force; and a link mechanism configured to convert the rotational movement of the rotary member to a reciprocal linear movement, the reciprocal linear movement being used as a driving force of the translation member.

16. The image formation apparatus according to claim 12, further comprising:

a first photoconductive drum configured to be supplied with the particular color developer;

a second photoconductive drum configured to be supplied with the further color developer; and a drum driving force transmission mechanism configured to transmit the rotational driving force to the first photoconductive drum and the second photoconductive drum.

17. The image formation apparatus according to claim 12, wherein the particular color is black.

* * * * *